United States Patent [19]

Johnson

[11] 4,418,806

[45] Dec. 6, 1983

[54] THREE COMPARTMENT TRAVEL BAG

[76] Inventor: Rheuben C. Johnson, 8904 Pawnee, Leawood, Kans. 66206

[21] Appl. No.: 409,954

[22] Filed: Aug. 20, 1982

[51] Int. Cl.[3] ..... A45C 3/00; A45C 13/00; A45C 13/26

[52] U.S. Cl. ..... 190/111; 190/109

[58] Field of Search ..... 190/41 R, 41 B, 41 Z, 190/42, 43, 44, 51, 52, 57

[56] References Cited

U.S. PATENT DOCUMENTS

| | | | |
|---|---|---|---|
| 2,394,782 | 2/1946 | Kalske | 190/57 X |

FOREIGN PATENT DOCUMENTS

| | | | |
|---|---|---|---|
| 128496 | 7/1948 | Australia | 190/51 |
| 1416567 | 9/1965 | France | 190/51 |
| 1452648 | 8/1966 | France | 190/51 |
| 1562995 | 3/1969 | France | 190/52 |
| 626557 | 10/1961 | Italy | 190/43 |
| 691689 | 7/1965 | Italy | 190/52 |
| 83885 | 8/1954 | Norway | 190/41 R |
| 22100 | of 1906 | United Kingdom | 190/52 |

*Primary Examiner*—William Price
*Assistant Examiner*—Sue A. Weaver

[57] ABSTRACT

A three compartment travel bag as three interconnected sections forming the compartments. The connection between sections is a flexible hinge-like arrangement so that the sections can be folded out from a stacked relationship in which all compartments are accessible from above. The flexible carrying strap is loosely connected with certain section sidewalls in order to permit the necessary movement of the sections relative to one another during the stretching out manipulation and refolding into the stacked condition.

9 Claims, 4 Drawing Figures

THREE COMPARTMENT TRAVEL BAG

BACKGROUND OF THE INVENTION

This invention relates to travelers luggage and refers more particularly to a special travel bag having particular appeal to those traveling by car or in other vehicles in which the trunk or storage space is of generally restricted volume and surrounded by a sidewall or other constraints so that the luggage must be lifted out of and dropped into the space.

Many forms of luggage designs have been developed over the years, each new design in most cases being oriented to filling a special need for travelers. The popularity of air travel and negative attitude of passengers toward checking luggage with the airline have together motivated designs which provide for easy handling and under the seat or hanger type storage and which can be carried on and off the airplane. These may or may not have shoulder straps or multiple pockets for separate storage of clothing and other items.

In my experience little effort has gone into developing improved designs for luggage whose primary use lies specifically in highway travel by private automobile. Most conventional suit cases and bags are two compartment arrangements with a handle on the openable side edge of the bag. There are other bags like "barracks" bags which are foldout and have pockets, but these, too, usually have the handle located so that the clothing pockets or compartments are "on edge" when the bag is being carried or manipulated by its handle. The location of the handle and the overall configuration of such bags makes them somewhat difficult to stow neatly and compactly in and to remove easily from the trunk of an automobile.

SUMMARY OF THE INVENTION

One of the principal objects of my invention is to provide a travel bag having at least three separate sections providing compartments which, when in normal transportation use, are arranged so that the compartments are stacked vertically one on top of another, yet also so arranged as to permit the sections to be unfolded and laid out in serially connected relationship on a bed or shelf so that each of the compartments is immediately and selectively accessible for removal or packing of items to be carried without requiring movement or repositioning of the other sections.

It is a feature of my invention that each compartment remains horizontal both while the compartments are stacked for traveling and while unfolded for complete access, thus permitting clothing to lay flat.

Another important feature of the invention is that the compartment walls are of a soft, very flexible material which permits the bag to be fitted into irregularly shaped spaces while still achieving "flat" storage of clothing and other items.

It is a further feature of my invention that a carrying strap is included as part of the bag, the strap being so arranged that it provides a way of easily handling the bag when in use with the bag sections vertically stacked on one another and not turned on edge, yet permits the ready unfolding of the sections and placement of the strap away from a position which it will interfere with access to the individual compartments.

Another important object of my invention is to provide a bag of the character described in which each compartment is separate and distinct from the other, with means to separate them even when the compartments are in a stacked condition.

Still another important object of my invention is to provide a travel bag arrangement which is simple in construction, economical to produce and capable of a long and useful life.

Other and further objects of the invention, together with the features of novelty appurtenant thereof will appear in the course of the following description.

DETAILED DESCRIPTION OF THE INVENTION

In the accompanying drawings which form a part of the specification and are to be read in conjunction therewith, and in which like reference numerals indicate like parts in the various views.

The bag of my invention is made up of at least three separate sections, each of which forms a separate compartment. The sections are identified as the bottom or lower section 10, the intermediate section 12, and the top section 14. Each section is similar in horizontal plan and dimensions with the others.

Figure 3:
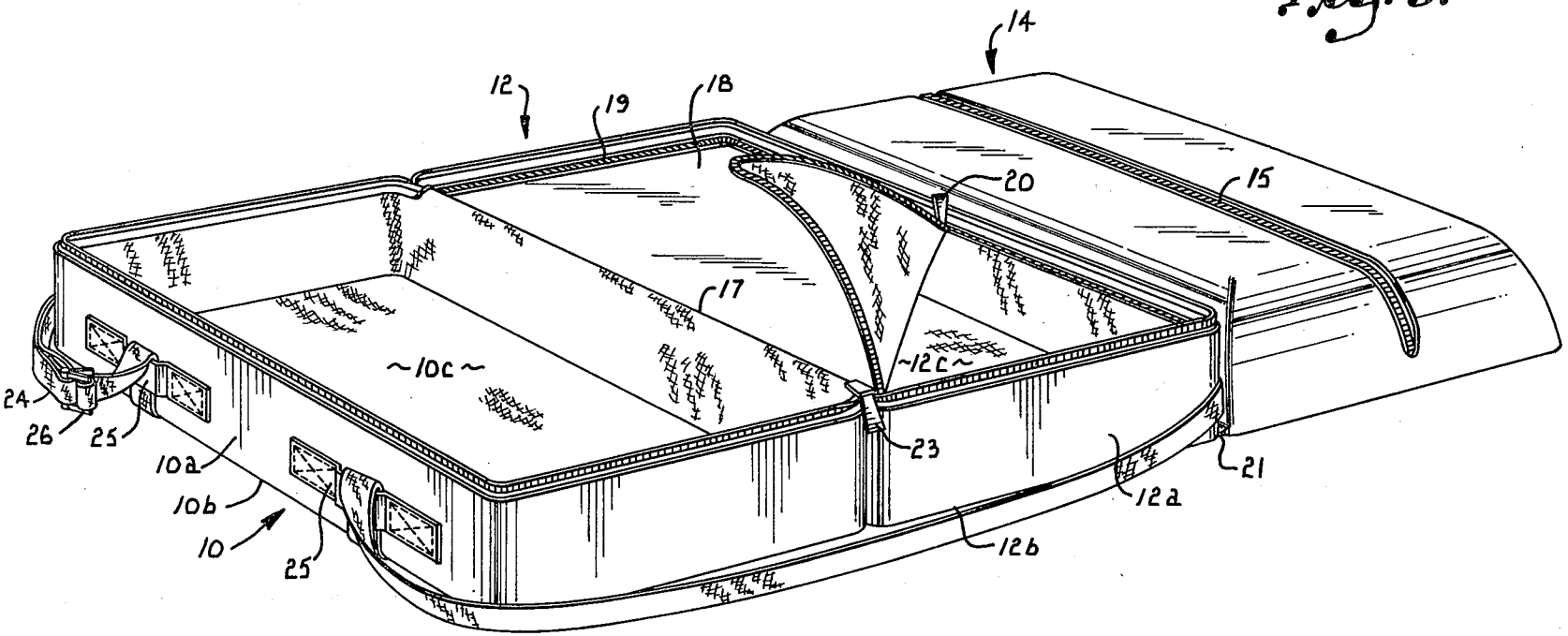
FIG. 3 is a perspective view of same with the bag shown in its folded out and extended condition with all compartments accessible from above.

The bottom and intermediate sections are also similar to one another in overall depth. Each has a substantially vertical continuous sidewall, identified at **10*a* and 12*a*, respectively. The sidewall 10*a* is connected at its lower edge 10*b* to the perimeter of a bottom panel 10*c*, which forms the closed bottom for the bottom section 10. The lower edge (12*b* as seen in FIG. 3) of section 12 is also connected with the perimeter, a solid panel 12*c* to provide a closure for one face of the section 12. When the bag is in the stacked condition shown in FIG. 1, the edge 12*b* and panel 12*c*** are uppermost.

In the preferred embodiment, the top section 14 is provided with a bottom panel, **14*a* which forms a fixed closure for the compartment formed by the section 14, and a generally rounded upper wall construction 14*b* which provides a somewhat dome-like configuration to the top compartment. The top compartment is provided with a slit 15 in the wall running generally end to end and which is sealed by a slide fastener or displaceable closure means 15*b* having the slide tab 16** by which the opening and closing of the slit can be controlled. The slide fastener may be of any conventional construction and its details are not a part of my invention.

As best shown in FIG. 3, the upper edges of the adjacent sidewall sections **10*a* and 12*a* of sections 10 and 12 are connected as at 17. This connection simply can be a stitched connection or by making the sidewalls continuous. This provides an arrangment whereby the upper section 12 may be swung to one side and adjacent the bottom section 10 as illustrated in FIG. 3, with the connecter section 17** serving a hinge-like function.

The intermediate section 12 is provided with a displaceable cover or partition 18 which is attached generally at one edge to the sidewall 12*a* along and adjacent the connecter portion 17 earlier described. The other edges of the closure 18 are releasably attached to the upper edges of the sidewall 12 by means of a (release) slide fastener 19 having the pull tab 20. The slide fastener goes around three sides of the section 12 and, as is evident, the closure 18 can either be closed or completely opened in order to expose the compartment within the sidewall 12*a* for access.

The top section 14 is hinged to the intermediate compartment 12, in a manner similar to the arrangement at 17, the hinge line being shown at 21. This arrangement permits the folding out of the top compartment to a horizontally and serially continuous position with respect to the intermediate and bottom sections so that all three sections can lie flat and side by side in the manner shown in FIG. 3, thus providing access to and through the top of each of the sections.

Figure 1:
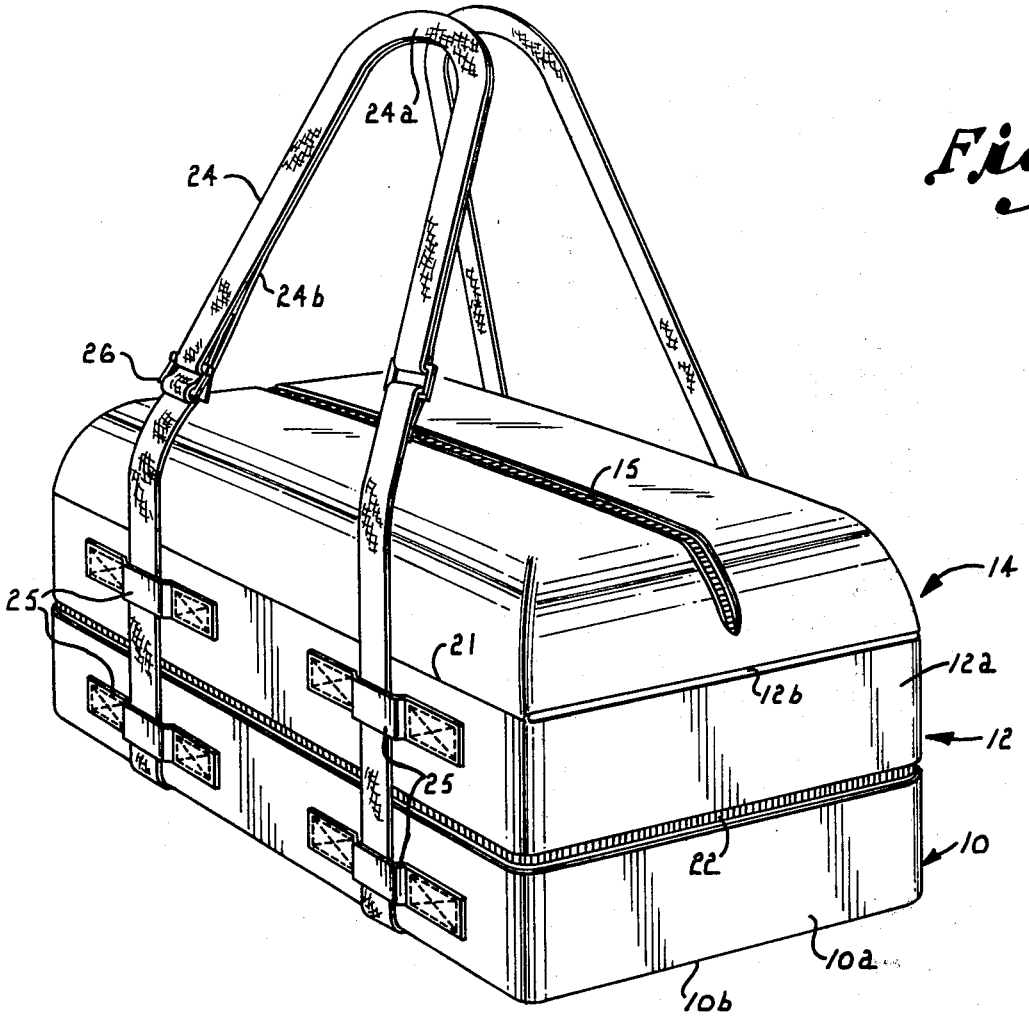
FIG. 1 is a perspective view of a preferred construction for a travel bag embodying my invention.
Figure 2:
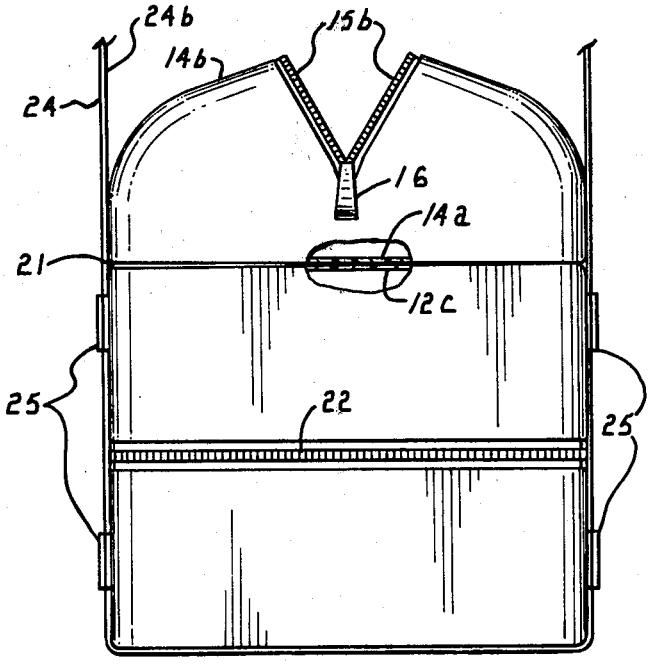
FIG. 2 is an end elevational view of same, portions of the straps being broken away and the top compartment being shown in an open condition.

The bottom and intermediate sections are also interconnected by a slide fastener 22, which serves to connect the two sections together in a substantially unitary fashion when the sections are stacked as in FIG. 1 and 2. The slide fastener is continuous around the end connected three sides of the upper and lower edges of the sidewalls 10*a* and 12*a*, respectively. Slide fastener 22 has a pull tab 23 which is operable to engage and disengage the respective portions of the fastener in the usual fashion.

Carrying means for the bag are provided in the form of an endless flexible strap 24. The strap is connected with the bottom section and intermediate section by means of strap loops 25 having end portions stitched or otherwise secured to opposite sidewalls of the sections. The strap is arranged so as to provide two bight portions 24*a* which can be gripped in the hand to provide a means of lifting and carrying the bag.

A length adjusting buckle 26 is interposed in the belt and cooperates with an extension 24*b* on the belt in order to increase or shorten the overall length of the belt so that the location of the hand grip portions 24*a* may be adjusted as desired, i.e., to lengthen them so that the bag can be shoulder carried or for other purposes.

Figure 4:
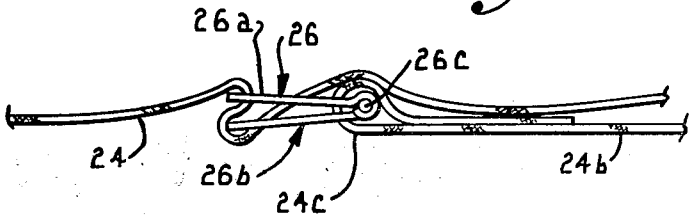
FIG. 4 is a fragmentary enlarged side elevational view of the strap buckle and associated portions of the strap, the strap shown twisted 180° from the FIG. 1 showing for purposes of illustration.

As best seen in FIG. 4, the buckle 26 comprises two open rectangular loops 26*a* and 26*b* hinged together as at 26*c* so that they are pivotal relative to one another about the hinge axis. The loops are preferably stamped or cut from sheet metal so as to provide them with rectilinear edges, particularly on the outside cross pieces on the outside of the loops. The end of extension section 24*b* of the belt has an end loop 24*c* in which the hinge is received in a loose fit. The belt 24 is threaded through the loops 26*a* and 26*b* in an S-curve. As will be evident, tension applied to the belt across the buckle results in a tendency to force the loops 26*a* and 26*b* toward one another thus to firmly grip the threaded belt portions with the edges of the loops.

To adjust the length it is simply necessary to relieve the tension, separate the two belt loops and adjust the lengthwise position of the belt relative to the buckle as desired.

As noted above, the straps are confined within the loops 25 in a loose fit and are freely slidable therein. Thus the straps will not interfere with opening of the bag to the open position of FIG. 3 and the strap can be moved to the sides of the sections to permit free access to the compartments.

The bag can be made of any suitable material such as leather, leatherized fabrics, fabrics alone, or other materials presently used for luggage. I prefer to have a fabric-like softwall construction, which reduces the overall the weight of the bag and provides no hard surfaces or corners which are more likely to be damaged or punctured than relatively flexible surfaces and which permits conformity to various shaped storage areas.

The general shape and arrangement of the bag makes it possible to provide a bag of substantially greater depth than is conventional with a generally smaller plan dimension. This facilitates handling of the bag in conjunction with storage in trunk compartments of automobiles. The flexible strap, plus its arrangement with the hand grips above the top section of the bag, facilitates the lifting of the bag and lowering of it into the trunk compartment.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A travel bag for carrying clothing and the like comprising:

at least three separate sections providing separate storage compartments having generally similar sidewall outlines, the sections being stacked on one another to provide a top section, a bottom section and in intermediate section between the top and bottom sections, the bottom and intermediate sections each having sidewalls providing upper and lower sidewall edges, the lower sidewall edges of the intermediate section registering with the upper sidewall edges of the lower section, the intermediate section has a closed top panel bordered by its upper sidewall edges, the bottom section has a closed bottom panel bordered by its lower sidewall edges, displaceable partition means separating the compartment formed within the intermediate section from that formed within the bottom section when the sections are in the stacked condition, means connecting the intermediate section to the bottom section whereby to permit swinging movement of said intermediate section from the stacked position thereon to an inverted position to one side of said bottom section thus to uncover the top of said bottom section, means connecting the top section to the intermediate section whereby to permit swinging movement of the top section relative to the intermediate section to one side of said intermediate section which side of said intermediate section is opposite from the connection with the bottom section, displaceable closure means for the top section permitting access to the top section compartment in either the stacked or side by side disposition of the sections, and a flexible carrier strap associated with the bottom and intermediate sections and providing hand grip portions which can be gripped and positioned above the top section for lifting the bag when the sections are in the stacked condition.

2. A travel bag as in claim 1, including releasable means for attaching the intermediate section to the bottom section thereby to maintain the registering sidewall edges of the respective sections against separation.

3. A travel bag as in claim 2, said releasable means comprising a slide fastener interconnecting said sidewall edges.

4. A travel bag as in claim 1, said displaceable partition comprising a flexible panel releasably secured along portions of its edges to the lower sidewall edges of said intermediate section.

5. A travel bag as in claim 4, said flexible panel releaseably secured along said edge portion by a sliding fastener.

6. A travel bag as in claim 4, said displaceable closure means comprising a slit-like opening closed by a sliding fastener.

7. A travel bag as in claim 1, said carry strap having portions passing beneath the bottom section and upwardly along opposite sides of the bottom and intermediate sections, and means loosely connecting said strap at locations on the exterior of the sidewalls of said bottom and intermediate sections.

8. A travel bag as in claim 1, including means for selectively adjusting the overall effective length of said carry strap.

9. A travel bag as in claim 8, said last named means including two loop members hinged to one another on a common edge, said strap threaded through the loops in an S-curve.

* * * * *